US010231060B2

(12) United States Patent
Riechers et al.

(10) Patent No.: US 10,231,060 B2
(45) Date of Patent: Mar. 12, 2019

(54) ELECTROSTATIC HEADPHONES

(71) Applicant: Sennheiser electronic GmbH & Co. KG, Wedemark (DE)

(72) Inventors: Jörg Riechers, Wedemark (DE); Manfred Hibbing, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/386,362

(22) Filed: Dec. 21, 2016

(65) Prior Publication Data

US 2017/0188158 A1 Jun. 29, 2017

(30) Foreign Application Priority Data

Dec. 23, 2015 (DE) ..... 10 2015 122 698

(51) Int. Cl.

| | |
|---|---|
| ***H04R 19/02*** | (2006.01) |
| ***H04R 7/06*** | (2006.01) |
| *H04R 1/10* | (2006.01) |

(52) U.S. Cl.

CPC ..... *H04R 19/02* (2013.01); *H04R 7/06* (2013.01); *H04R 1/1008* (2013.01)

(58) Field of Classification Search

CPC ... H04R 19/00; H04R 19/02; H04R 2307/027
See application file for complete search history.

(56) References Cited

U.S. PATENT DOCUMENTS

| | | | | | |
|---|---|---|---|---|---|
| 3,008,013 | A * | 11/1961 | Walker | H04R 19/02 | 381/116 |
| 3,084,229 | A * | 4/1963 | Brettell | H04R 19/02 | 381/191 |
| 3,135,838 | A * | 6/1964 | Wright | H04R 19/02 | 381/116 |
| 3,894,333 | A * | 7/1975 | Chang | H04R 19/013 | 29/594 |
| 3,941,946 | A * | 3/1976 | Kawakami | H01R 19/02 | 381/116 |
| 4,383,139 | A * | 5/1983 | Kanchev | H04R 19/02 | 381/191 |
| 6,393,129 | B1 * | 5/2002 | Conrad | H04R 19/00 | 381/191 |
| 6,584,206 | B2 * | 6/2003 | Ohashi | H04R 19/02 | 381/174 |
| 7,810,224 | B2 * | 10/2010 | Van Dongen | H04R 19/02 | 29/594 |
| 9,031,266 | B2 * | 5/2015 | Dehe | H04R 19/013 | 381/191 |
| 9,277,327 | B2 * | 3/2016 | Terazono | H04R 1/00 | |
| 9,516,426 | B2 * | 12/2016 | Pinkerton | H04R 7/02 | |

(Continued)

FOREIGN PATENT DOCUMENTS

| | | |
|---|---|---|
| DE | 41 15 221 | 12/1992 |
| DE | 43 29 991 | 3/1995 |

*Primary Examiner* — Curtis A Kuntz
*Assistant Examiner* — Ryan Robinson
(74) *Attorney, Agent, or Firm* — Haug Partners LLP

(57) ABSTRACT

An electrostatic transducer has two oppositely disposed counter-electrodes and a diaphragm which is disposed between the two counter-electrodes and which has a first weakly conductive coating. In its edge region the diaphragm has a second well-conductive coating on the first coating to protect the latter.

16 Claims, 2 Drawing Sheets

(56) References Cited

U.S. PATENT DOCUMENTS

| | | | | |
|---|---|---|---|---|
| 9,641,949 | B2 * | 5/2017 | Massoner | H04R 31/003 |
| 2007/0189559 | A1 | 8/2007 | Hann et al. | |
| 2008/0037815 | A1 * | 2/2008 | Ito | H04R 19/005 381/355 |
| 2009/0147972 | A1 | 6/2009 | Hwang | |
| 2012/0237069 | A1 * | 9/2012 | Harman | H04R 19/02 381/336 |

* cited by examiner

ELECTROSTATIC HEADPHONES

The present application claims priority from German Patent Application No. 10 2015 122 698.7 filed on Dec. 23, 2015, the disclosure of which is incorporated herein by reference in its entirety.

FIELD OF THE INVENTION

It is noted that citation or identification of any document in this application is not an admission that such document is available as prior art to the present invention.

The present invention concerns an electrostatic headphone.

An electrostatic headphone typically has two counter-electrodes and a diaphragm which is arranged therebetween and which has a thin metallic coating. The diaphragm which is actuated with an audio signal is driven in the electrostatic field of the counter-electrodes which are brought to a high electrical potential of differing polarity. The diaphragm is typically mechanically fixed in the edge region to a diaphragm or carrier ring, for example by gluing. The diaphragm side remote from the diaphragm ring is typically of a very weakly conductive configuration due to a very thin coating with metal. The coating can be on one or both sides. Electrical contacting of the diaphragm is typically effected in the edge region by applying a conductive contact ring which can be of the same shape as the diaphragm ring. The contact ring is typically made from the same material as the diaphragm ring.

The diaphragm of the electrostatic transducer requires a low level of conductivity. This is typically made possible by a conductive coating on the diaphragm, which must be very thin or extremely thin. By virtue of the small thickness of the conductive coating on the diaphragm electrical interruptions within the coating can occur due to mechanical stressing of the diaphragm.

On the German patent application from which priority is claimed the German Patent and Trade Mark Office searched the following documents: DE 41 15 221 A1, DE 43 29 991 A, US 2007/0189559 A1 and US 2009/0147972 A1.

SUMMARY OF THE INVENTION

An object of the present invention is to provide an electrostatic transducer for example for headphones, which reduces or avoids electrical interruption in the coating on the diaphragm due to mechanical stresses.

Thus there is provided an electrostatic transducer having two oppositely disposed counter-electrodes, a diaphragm between the two counter-electrodes and a contact ring for contacting the diaphragm (in its outer region). At least on one side the diaphragm has a first weakly conductive coating. In its edge region the diaphragm has a second well-conductive coating on the first coating.

The second coating projects beyond the contact ring.

According to an aspect of the present invention the second coating is in the form of a continuous annular coating or in the form of an annular coating with interruptions.

By virtue of the fact that the second coating projects beyond the contact ring (that is to say is provided at the edge region of the diaphragm), damage to the first coating at the inner edge of the contact ring can be reduced or avoided. The diaphragm thus has a first region having a first electrically conductive coating and a second region having a second electrically conductive coating. The first coating is a poor conductor and corresponds to the normal coating on a diaphragm for an electrostatic transducer. The second coating is provided in the edge regions of the diaphragm and serves as protection for the first coating. In that case the second coating which is a good conductor is typically thicker or more robust. The purpose of the second coating is in particular to protect the first coating in the region of an inner edge of the contact ring of the diaphragm. It is at that location that in operation constant mechanical stressing occurs due to the vibrating diaphragm. The second coating can be made from another material, for example a less expensive material, than the first coating.

The invention concerns the notion that slight mechanical stresses like stretching, bending, shearing and so forth or aging effects can lead to electrical interruptions in the coating on the diaphragm. In that respect in particular a transitional region at an inner sharp-edged edge of the contact ring can lead to problems. Very slight displacements of the contact ring under mechanical pressure can occur in particular upon assembly of the transducer. In addition, interruptions in the contact can also occur after prolonged operation. It should be noted that a movement of the diaphragm during operation of the transducer particularly stresses the coating. That also applies to the inner edge of the contact ring so that malfunctions can also occur after a prolonged period of operation.

According to the invention there is therefore provided an electrostatic transducer which permits secure contacting in the edge region of the diaphragm. For that purpose an additional (further) well-conductive coating is applied in the edge region of the diaphragm, that covers over part of or the entire region of the diaphragm ring and a partial region of the adjoining exposed diaphragm. This can therefore provide for secure electrical contacting of the contact ring bearing thereagainst, even in the case of a weakly conductive diaphragm coating. The diaphragm thus has a first thin electrically conductive coating. In the edge region of the diaphragm the diaphragm at least portion-wise has a second well-conductive coating. That coating can be annular and continuous or can be of an only portion-wise configuration.

It is thus possible to achieve in particular improved electrical contacting.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail the basis of exemplary embodiments.

Figure 1:
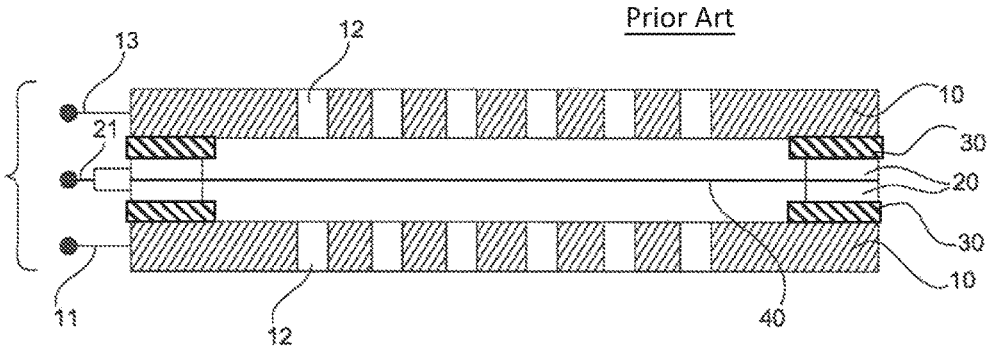
FIG. 1 shows a diagrammatic sectional view of an electrostatic transducer according to the state of the art.

FIG. 1 shows a diagrammatic sectional view of an electrostatic transducer according to the state of the art. The electrostatic transducer has two counter-electrodes 10 which are positioned in parallel and positively locking relationship at a spacing relative to each other. The spacing between the two counter-electrodes 10 can be afforded by two mutually superposed similar rings 20 and two insulating disks 30. A diaphragm 40 is arranged between the two diaphragm rings 20 and can be fixed on one of the two diaphragm rings 20. The second diaphragm 20 can be in the form of a contact ring. The counter-electrode 10, the diaphragm 40 and the rings 20 and the insulating disks 30 can be for example glued, screwed or clamped together. The counter-electrodes 10 and the rings 20 can be made from a conductive material. The counter-electrodes 10 and the rings 20 can have electrical terminals 11, 13, 21 for electrical contacting.

As an alternative thereto the counter-electrodes 10 can be made from an insulating material like for example ceramic, in which case the counter-electrodes 10 are then partially metalized. The counter-electrodes 10 can have a sound-transmissive perforation 12. The diaphragm ring and the contact ring 20 are electrically connected together. The diaphragm 40 can be made for example from a non-conducting plastic and at at least one side can have a weakly conductive coating. The diaphragm 40 can be of a weakly electrically conductive nature in particular at the side not glued to the diaphragm ring. The diaphragm 40 can be charged lay way of a dc voltage in relation to the counter-electrodes 10. The diaphragm together with the two counter-electrodes 10 can form an electrical capacitor which with the electrical resistance of the diaphragm forms a time constant for charge migration on the diaphragm. That time constant should be greater than the period duration of the lowest audio frequency to be transmitted. That is intended to apply the principle of constant charging which is a prerequisite for high linearity of the transducer.

A high dc voltage can be applied between the two counter-electrodes, that is to say at the electrical terminals 11, 13 in order to set them to high different potentials and thereby to generate an electrostatic field. An audio signal is connected to the diaphragm 40 by way of the contact ring 20. That signal is an electrical alternating signal which produces on the diaphragm an electrostatic force varying with the frequency of the audio signal. In that way the diaphragm is deflected in accordance with the signal voltage.

Figure 2:
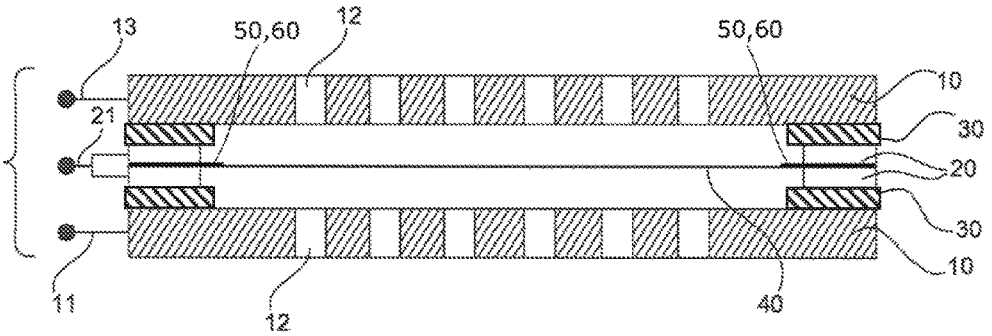
FIG. 2 shows a diagrammatic sectional view of an electrostatic transducer according to the invention.

FIG. 2 shows a diagrammatic sectional view of an electrostatic transducer according to the invention. The structure of the electrostatic transducer shown in FIG. 2 is based on that of the electrostatic transducer of FIG. 1. In addition thereto the electrostatic transducer according to the invention, at the edge of the diaphragm 40, has a second coating 50, 60 in the form of a reinforced diaphragm metallization which extends inwardly beyond the contact ring.

Figure 3:
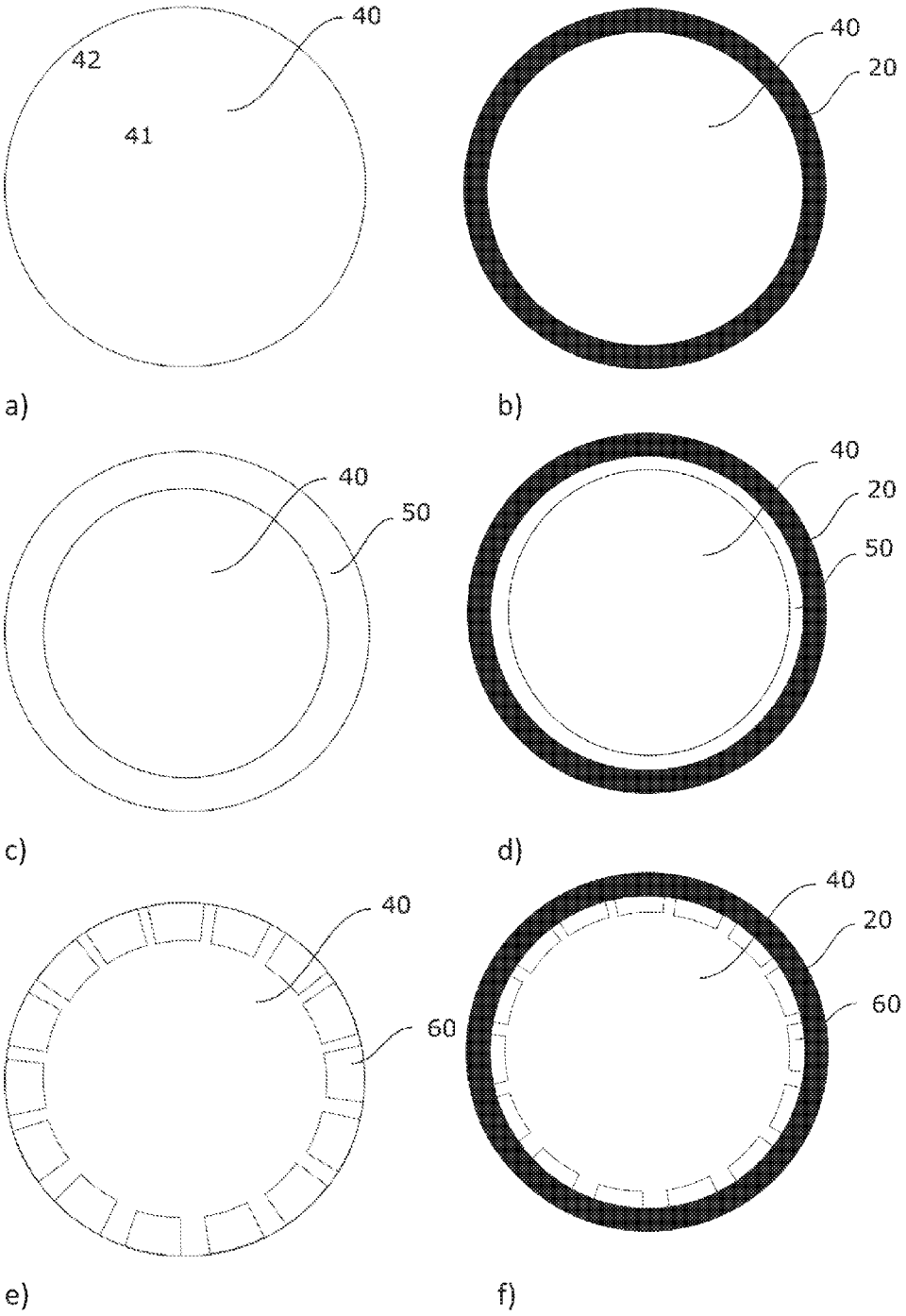
FIG. 3 shows a diagrammatic view of a diaphragm of the electrostatic transducer of FIG. 2.

FIG. 3 shows a plan view of a diaphragm 40 of the electrostatic transducer of FIG. 2. The diaphragm can be circular as shown in FIG. 3*a*) and can firstly have a diaphragm ring 20. A weakly conductive, coated diaphragm 40 can be glued on the diaphragm ring 20, as in FIG. 3*b*). That first coating 41 can extend similarly over the entire diaphragm surface, inclusive of the edge region 42 which covers the diaphragm ring. A second coating 50 can be provided at the edge region 42 of the diaphragm, as in FIG. 3*c*). That second coating 50 is a transitional coating which is a good conductor. That coating 50 can also be provided in an annular configuration in the edge region 42 of the diaphragm 40, that covers over at least a partial region of the diaphragm ring 20 and projects inwardly beyond the contact ring 20 so that it is possible to ensure secure electrical contacting of the diaphragm coating with respect to the contact ring 20 bearing thereon. That is shown for example in FIG. 3*d*). This therefore provides a continuous annular second coating 50. The diaphragm ring or contact ring 20 is separated from the counter-electrodes 10 by insulating rings 30.

Alternatively the arrangement comprising the diaphragm 40, the diaphragm ring or contact ring 20, the insulating rings 30, the edge region 42 and the second coating 50 can also be oval.

According to an aspect of the present invention which is shown in particular in FIG. 3*e*) the second coating 50 is not in the form of a continuous annular coating but in the form of an annular coating with radial interruptions 60. Here too a part of the annular coating with radial interruptions 60 projects under the contact ring 20, as shown in FIG. 3*f*). Those radial interruptions are advantageous if the second coating 60 is to be effected by vapor deposition or sputtering by means of a template.

According to the invention therefore transmissive partial regions of the templates are connected together by limbs. The width of the limbs can be markedly less than the width of the coated segments.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An electrostatic transducer comprising:

two oppositely disposed counter-electrodes;

a diaphragm which is disposed between the two counter-electrodes and which has a first conductive coating;

a conductive contact ring;

wherein an edge region of the diaphragm has a second conductive coating on the first conductive coating;

wherein the second conductive coating is in electrical contact with the conductive contact ring and projects inwardly beyond the conductive contact ring; and wherein the second conductive coating is in form of a reinforced diaphragm metallization extending inwardly beyond the conductive contact ring.

2. The electrostatic transducer as set forth in claim 1;

wherein the second conductive coating is in the form of a continuous annular coating.

3. The electrostatic transducer as set forth in claim 1;

wherein the second conductive coating is in the form of an annular coating with interruptions.

4. The electrostatic transducer as set forth in claim 1;

wherein the second conductive coating is made from a different material than the first conductive coating.

5. The electrostatic transducer as set forth in claim 1;

wherein the second conductive coating is thicker than the first conductive coating.

6. A headphone comprising:

an electrostatic transducer as set forth in claim 1.

7. The electrostatic transducer as set forth in claim 1;

wherein a conductivity of the second conductive coating is greater than or equal to that of the first conductive coating.

8. The electrostatic transducer as set forth in claim 7;

wherein the conductivity of the second conductive coating is greater than that of the first conductive coating.

9. The electrostatic transducer as set forth in claim 1;
wherein the conductive contact ring is made from a conductive material.

10. An electrostatic transducer comprising:
two oppositely disposed counter-electrodes;
a diaphragm which is disposed between the two counter-electrodes and which has a first conductive coating;
a conductive contact ring;
wherein an edge region of the diaphragm has a second conductive coating on the first conductive coating;
wherein the second conductive coating is in electrical contact with the conductive contact ring and projects inwardly beyond the conductive contact ring; and
wherein the second conductive coating is in the form of an annular coating with interruptions.

11. The electrostatic transducer as set forth in claim 10;
wherein the second conductive coating is made from a different material than the first conductive coating.

12. The electrostatic transducer as set forth in claim 10;
wherein the second conductive coating is thicker than the first conductive coating.

13. A headphone comprising:
an electrostatic transducer as set forth in claim 10.

14. The electrostatic transducer as set forth in claim 10;
wherein a conductivity of the second conductive coating is greater than or equal to that of the first conductive coating.

15. The electrostatic transducer as set forth in claim 14;
wherein the conductivity of the second conductive coating is greater than that of the first conductive coating.

16. The electrostatic transducer as set forth in claim 10;
wherein the conductive contact ring is made from a conductive material.

* * * * *